United States Patent [19]

Barnwell

[11] Patent Number: 4,768,354

[45] Date of Patent: Sep. 6, 1988

[54] HEAT TREATMENT CUP FOR A BEVERAGE CONTAINER

[76] Inventor: Keith Barnwell, 26 Queensway Dr., Chatham, Ontario, N7M 4G4, Canada, N7M 4B4

[21] Appl. No.: 121,865

[22] Filed: Jan. 15, 1988

Related U.S. Application Data

[63] Continuation-in-part of Ser. No. 11,930, Feb. 6, 1987.

[51] Int. Cl.[4] ..... F25D 3/08

[52] U.S. Cl. ..... 62/457; 62/530; 220/428

[58] Field of Search ..... 62/457, 530; 220/428

[56] References Cited

U.S. PATENT DOCUMENTS 4,183,226 1/1980 Moore ..... 62/457

4,299,100 11/1981 Crisman et al. ..... 62/457

*Primary Examiner*—Lloyd L. King

[57] ABSTRACT

The present invention provides a temperature influencing receptacle for receiving a beverage container. The receptacle comprises an outer insulating cover and an inner insert held within the insulating cover. The insert comprises interfitting cup-like members with a temperature conditionable fluid trapped between the two cup-like members. Provided at the top of the receptacle is a mouth piece of lesser inside diameter than the inside diameter of the insert for gripping on the container and preventing its contact with the insert.

11 Claims, 4 Drawing Sheets

FIG.1.
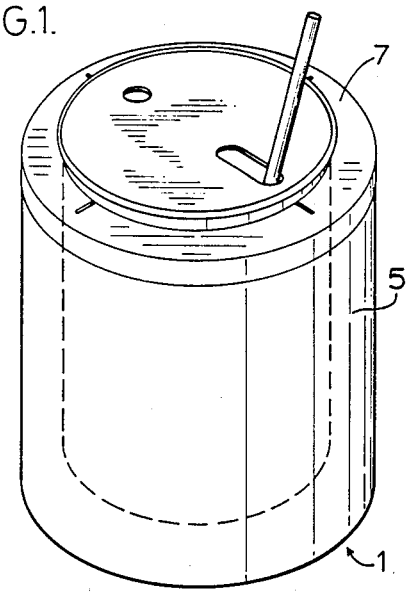
FIG.3.
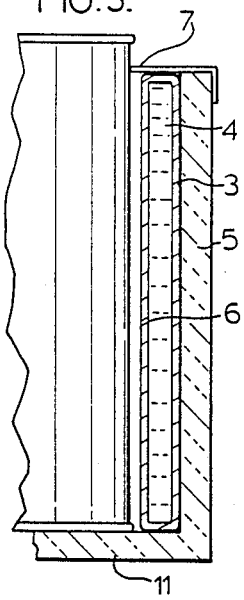
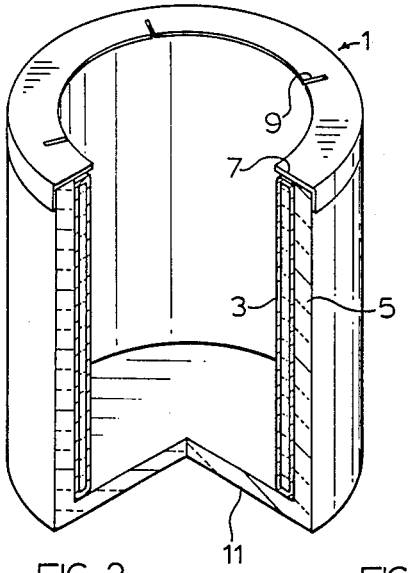
FIG. 2.
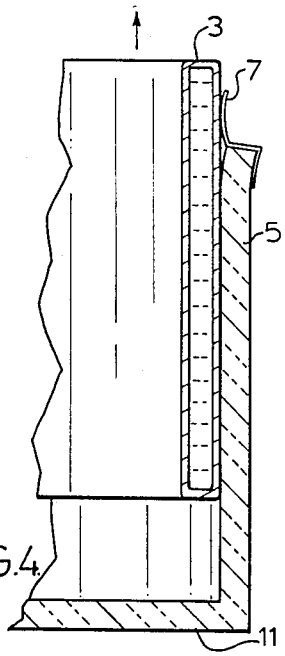
FIG.4.

FIG.7.
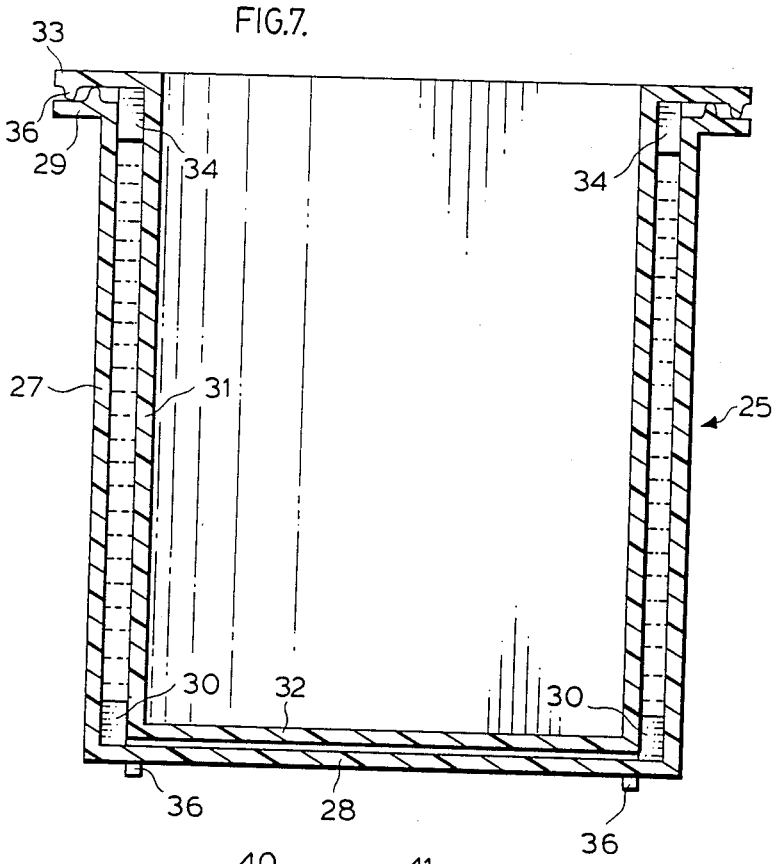
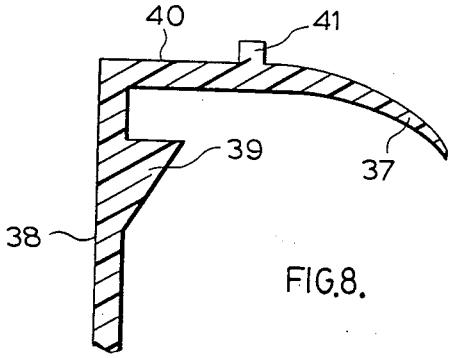
FIG.8.

HEAT TREATMENT CUP FOR A BEVERAGE CONTAINER

This application is a continuation in part of application Ser. No. 07/011,930 filed Feb. 6, 1987.

FIELD OF THE INVENTION

The present invention relates to a cup or cup like receptacle for receiving and heat treating, either by way of heating or cooling, a beverage container such as a can or bottle of beer.

BACKGROUND OF THE INVENTION

To date, there is very little available in the way of bottle or can insulating jackets. One product that is available in the market place is in the form of a styrofoam cup which can be slid over the bottom of a can or bottle. However, this cup has no direct heating or cooling effect on the beverage in the can or bottle and provides an insulating effect only.

Very recently a new refrigeratable beverage container holder has been introduced to the market place. This particular product includes a interior refrigeratable liquid for providing a cooling effect on a container, typically a beer can, fitted in the holder. Descriptions of this product as well as methods of manufacturing of the product are found in U.S. Pat. Nos. 4,163,374, 4,183,226, 4,299,100 and 4,378,625 all owned by Freezesleeves of America Inc.

The above patents describe a number of different holder designs. However, each of these designs is based on the standard styrofoam cup as earlier described with the dead air space between the styrofoam cup and the beer can being filled by refrigerant or a refrigerant lining physically engaging the beer can. In use, it has been found that if the refrigerant is truly effective it cannot touch the beer can in as much as this may result in freezing of the can contents.

Another difficulty found in the Freezesleeve design where, as shown for example in FIG. 4 of U.S. Pat. No. 4,163,374, the refrigerant is simply trapped between an inner lining and the styrofoam cup is to provide a seal which will not allow leakage of the refrigerant. According to U.S. Pat. No. 4,163,374 this is achieved by physically embedding a part of the lining into the styrofoam cup. However, again it has been found that in use this type of sealing is not entirely effective because of the weakness of the styrofoam which tends to crack and break resulting in the refrigerant leaking between the lining and the cup.

U.S. Pat. No. 4,183,226 shows in FIGS. 2 and 3 two other embodiments of the Freezesleeve's holder. Each of these embodiments comprises a totally independent refrigerant lining again designed to circumferentially engage the beer can. Although these two linings do not suffer from the same leakage problem described above, they are difficult and expensive to manufacture and do not present any surface for positive engagement with the outer styrofoam cup.

SUMMARY OF THE PRESENT INVENTION

The present invention provides a heat treatment receptacle for a beverage container. The receptacle comprises an outer insulating cover and an insert within the insulating cover which is temperature settable for influencing the temperature of the beverage container. The insert is in the form of inner and outer cup-like members each of which comprises an opened top closed bottom, generally cylindrical, body and an outwardly extending flange or shoulder around the open mouth of each cylindrical body. The two cup-like members are telescopically interfitted with one another having bottom to bottom and flange to flange contacts with the cylindrical body on the inner cup-like member being of reduced diameter to that of the outer cup-like member defining a wall gap in the insert. A temperature conditionable liquid preferably in the form of a freezer gel is trapped in the wall gap.

The two flanges on the cup-like members with the flange on the inner cup overlapping the flange on the outer cup extend outwardly over the upper edge of the insulating cover with the insert and the cover then being locked together by means of a snap fitted ring at the mouth of the receptacle. This ring includes an inwardly directed lip of lesser interior diameter than the insert with substantial overhang above the insert for gripping on the container and for preventing its contact with the insert when the container is fitted into the receptacle.

BRIEF DISCUSSION OF THE DRAWINGS

The above, as well as other advantages and features of the present invention, will be described in greater detail according to the preferred embodiments of the present invention in which:

FIG. 1 is a perspective view showing a beverage can fitted into a cooler cup according to a preferred embodiment of the present invention;

FIG. 2 is a partially sectioned perspective view showing only the cooler cup of FIG. 1;

FIG. 3 is an enlarged sectional view of one side of the cooler cup and fitted beverage can of FIG. 1;

FIG. 4 is a view similar to FIG. 3 with the beverage can removed and showing the removal of the sleeve insert from the outer insulating cover;

FIG. 7 is a partially assembled sectional view of the gel containing insert of the cooler cup of FIG. 5.

FIG. 8 is an enlarged sectional view of the ring of the cooler cup of FIG. 5.

Figure 5:
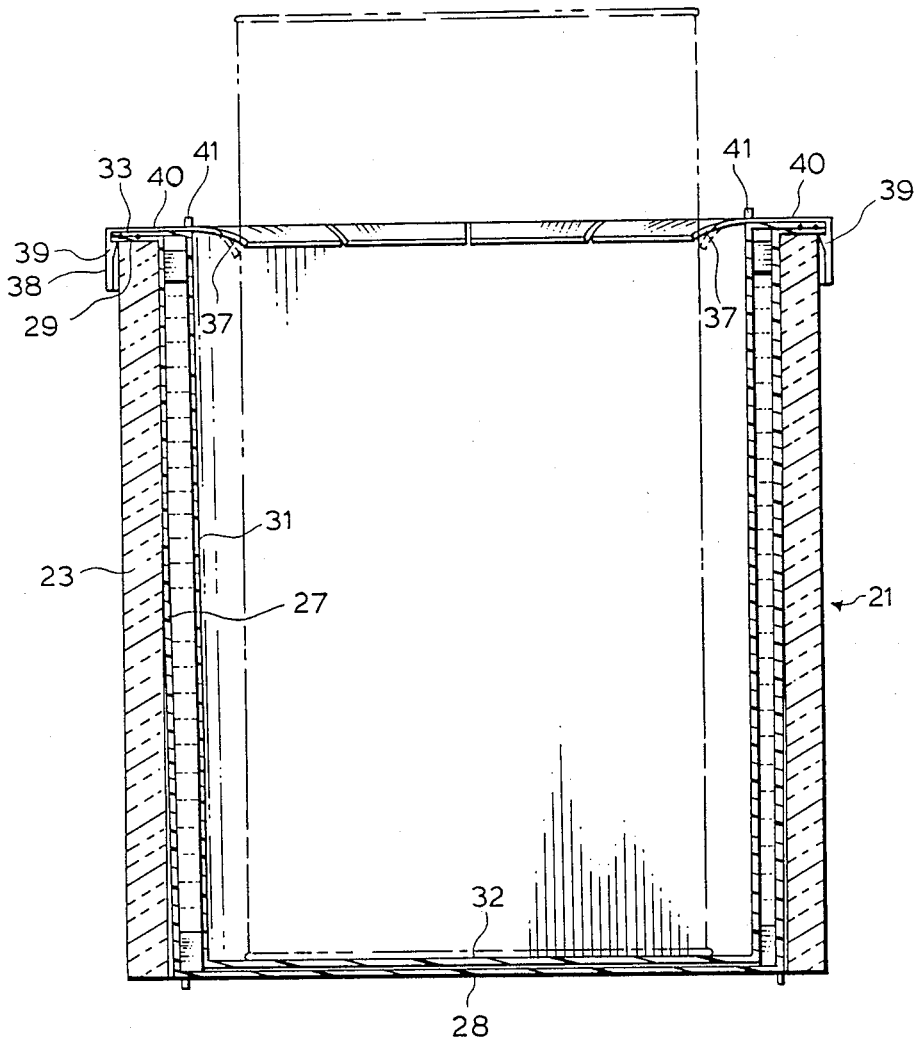
FIG. 5 is a sectional view showing a beverage can fitted into a cooler cup according to a further preferred embodiment of the present invention.

DETAILED DESCRIPTION ACCORDING TO THE PREFERRED EMBODIMENTS OF THE PRESENT INVENTION

FIGS. 1 and 2 show a heat treatment cup and in particular a cooler cup generally indicated at 1 for receiving a beverage container. Although the drawings show a beverage can, it is to be appreciated that a bottle or even a glass can also be used with the heat treatment cup of the present invention.

The cooler cup comprises an internal sleeve 3 and an external insulating cover 5. The sleeve, which has a hollow construction, is filled with a non-toxic freezer gel 4 sealed within the sleeve. In order to temperature condition the cup, i.e. bring it down to a cold temperature, it is simply placed in a refrigerator or freezer to lower the temperature of the gel in the sleeve which will then remain at its lowered temperature because of the insulating properties of cover 5. Also, the sleeve is isolated from any outside warming influences when the beverage can itself is fitted in position because the mouth of the cup, defined by inwardly extending ring 7, tightly grips on the beverage container and the container, when fully inserted, seats on the bottom portion 11 of the insulating cover. Accordingly, because there is no travel of air into or out of the cooler when the beverage container is in position, a dead air space 6 is trapped between the container and the cooling sleeve. Therefore, the container acts as a sealing member and the insert is subject to very little heat pick up while providing a cooling effect on the beverage container. As will be seen in FIGS. 1 and 3, the height of the cup is dimensioned to provide very little exposure of the container to keep heat pick up of the container from the ambient air to a minimum.

The insert itself can be reduced to a temperature where gel 4 actually freezes and although the purpose of the insert is to provide a cooling effect, it should not come into contact with the container which might otherwise freeze the beverage in the container. Accordingly, ring 7 of the insulating cover not only grips the can but provides the required spacing element for keeping the container and the insert out of contact with one another as shown in FIG. 3.

The ring itself while being bendable under force is stiff enough to grip the container, preferably a beer can, to the extent that if the can is lifted the entire heat treatment cup remains positively engaged with the can. Furthermore, under a non-can engaging position, the ring projects inwardly with substantial overhang above the insert ensuring a large gap between the can and the insert. In its relaxed condition, the interior diameter of the ring is slightly less than the diameter of a standard beer can while the interior diameter of the insert is substantially greater than that of a beer can.

In the preferred form of the present invention, sleeve 3 comprises a molded plastic insert removable from the outer insulating cover which is preferably made from a closed cell soft foam material. The softness of the foam allows positive hand hold on the cup and also allows some stretching of the cover for fitting over the insert. In order to facilitate removal of the insert, ring 7, which is preferably a resilient plastic material, is provided with a plurality of slits 9 which substantially ease the upward bending of the ring to pull the insert out of the insulating cover. The split ring arrangement also eases the tight fitting of the container into the cup.

According to the preferred construction described immediately above, both the cover and the sleeve are replaceable independently of one another if required. However, it should be noted that there is no need to remove the sleeve from the cover during the temperature conditioning as, for example, placing the assembled structure in the refrigerator or freezer.

Figure 6:
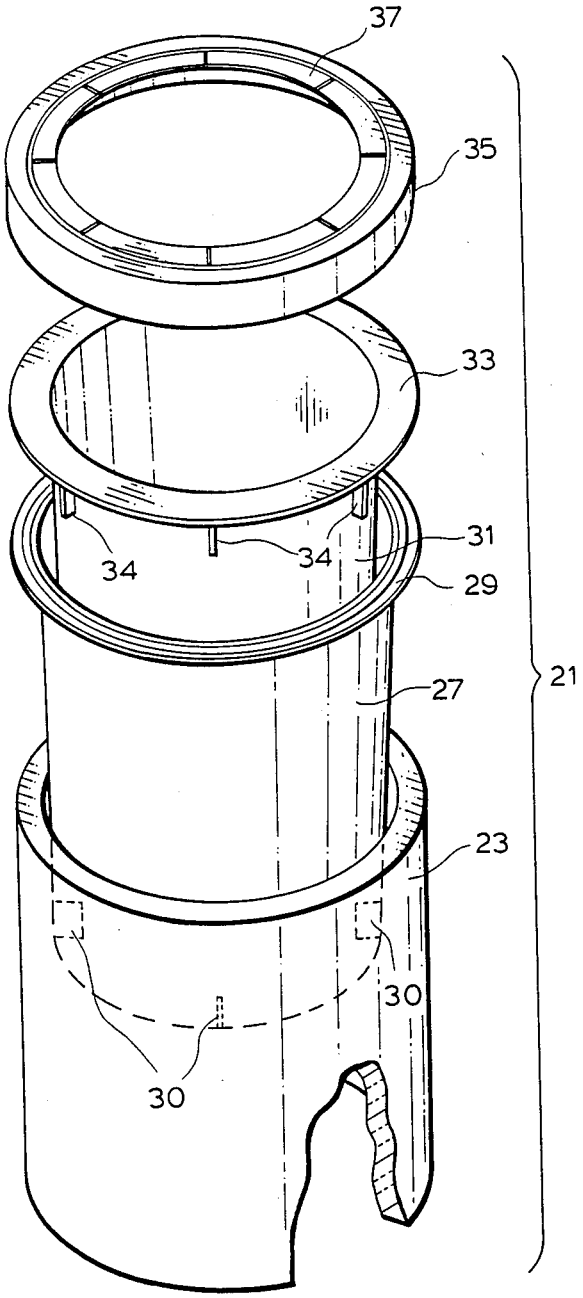
FIG. 6 is an exploded perspective view of the cooler cup of FIG. 5.

FIGS. 5 and 6 show a further cooler cup generally indicated at 21. This cooler cup comprises an outer insulating cover 23 and an insert 25 fitted within the insulating sleeve. FIG. 7 shows details of the insert and FIG. 8 shows details of the ring defining the mouth of the cup.

The insert itself is formed by a pair of hard plastic cup like members 27 and 31, with member 31 being telescopically fitted within member 27. Each of these cup like members comprises a main cylinidrical body with a closed bottom as indicated at 28 on cup like member 27 and at 32 on cup like member 31. Further, each of the cup like members is provided with outwardly extending lips as indicated at 29 and 33 on cups 27 and 31 respectively.

Receptacle 21, and in particular insert 25, has been designed for efficiency of manufacturing and structural integrity of the receptacle. This is achieved through the cup within a cup formation of the insert. As can be well seen in FIG. 5, the cylindrical body on cup 27 is larger in diameter than that of cup 31 providing a hollow sidewall in the insert. This hollow sidewall is of consistent gapping completely around the insert due the provision of centering means to center cup 31 within cup 27. This centering means is in the form of a series of small outwardly extending centering fins 34 provided around the upper end of inner cup 31 and inwardly extending centering fins 30 provided around the lower end of cup 27. Therefore, when the two cups are interfitted with one another centering fins 34 on cup 31 abut the interior sidewall of cup 27 while centering fins 30 on cup 27 abut the exterior wall on cup 31 around the insert to ensure proper centering of the two cups and as mentioned above a uniform gap in the sidewall around the insert.

When the insert is fully assembled, as shown in FIG. 5, the bottom wall 32 of cup 31 sits atop the bottom wall 28 of cup 27. Also, because the two cups are of generally identical height lip 33 of cup 31 sits flushly atop and is sealed to lip 29 of cup 27. Also note that outwardly projecting lip 33 is longer than lip 29 so that the two lips terminate at the same outer edge with lip 33 being lengthened inwardly to span the hollow sidewall to the cylindrical body of cup 31.

The actual loading of the gel into the cup-like insert is achieved in the following manner. The gel is initially loaded directly into cup 27 following which cup 31 is then located in position. The gel itself is quite dense with very little flow characteristics necessitating not only a pushing together of the two cups but also a spinning of one cup relative to the other to displace the gel from the bottom of cup 27 up into the gap in the insert sidewall. In particular, cup 27 is rotated relative to cup 33 with the small fins 30 in the bottom of cup 27 acting in an impeller-like fashion to agitate the gel and cause it to move upwardly along the outside of cup 31 which is slowly being forced down into the rotating cup 27. Therefore, fins 30 not only provide a centering means at the bottom of the two cup-like members but in addition provide a means for proper dispersing of the gel during assembly of the insert itself.

After the gel is loaded, the bottom of cup 31 pushes down onto the bottom of cup 27 generally free of gel between the bottom walls of the two cups. Accordingly, there is very little, if any, gel at the bottom of the insert where the can sits directly on the inner cup bottom wall 32.

FIG. 7 shows the two cup-like members after loading the insert with gel and just prior to sealing the two cup-like members to one another. The gel after loading is prevented from escaping upwardly out of the insert by sonically welding lips 29 and 33 of the two cup-like members to one another. To assure a complete weld around the insert, lip 33 is provided with a continuous downwardly extending meltable plastic bead 36 while lip 29 is provided with a continuous upwardly extending similar bead 28. During the sonic welding these two beads melt to seal the lips to one another. The reason for providing two beads inwardly and outwardly surrounding one another is that should one of the beads not properly seal at any point around its periphery the other bead provides a second seal to cover any possible gaps and prevent leakage of the gel from the cup.

Another feature provided by the cup in a cup insert construction is that it again simplifies the construction of the outer insulating cover which is nothing more than a hollow cylindrical sleeve of relatively stretching foam material. The bottom of the cooler cup is provided by the bottom wall of the insert itself rather than the insulating cover. The insert being formed by a relatively hard plastic and having the double thickness of bottom walls 32 and 28 is much more durable and resistant to damage than for example a styrofoam bottom as found in the prior art. In addition, by making the bottom of the insert the bottom of the cup this allows the molding of a hard plastic sweat bead 36 on the bottom of insert cup 27. This sweat bead eliminates a full contact of bottom wall 28 with any supporting surface on which the cooler cup is placed providing a condensation guard to prevent both moisture marking of and sticking to the supporting surface.

As described above, one of the unique features of the present invention is in the gripping of the upper ring of the cooler cup onto the container or beer can with no contact between the gel filled sidewall of the insert and the can. FIGS. 5 and 6 show cooler cup 21 as being provided with an upper ring 35 specific details of which are shown in FIG. 8 of the drawings.

Ring 35 comprises an outer sidewall 38 having an inwardly directed undercut portion 39, a top ring portion 40 and a series of inwardly directed gripping portions 37. The undercut portion 39 on the outer ring sidewall snap fits over the insert flange which extends slightly outwardly beyond the insulating cover 23 to provide an interlock surface between the undercut ring and the insert. Although there is also a slight grip of ring sidewall 38 on outer cover 23, this is not the force holding the outer cover in position over the insert. Rather, the cover remains in position due to its stretch fitting over the insert.

The top ring wall 40 which extends across the top of the gel filled insert includes a reinforcing rib 41 just outwardly of the container or can grip portions 37 of the ring. These portions 37 are preformed with a slight downward bend as best seen in FIG. 8 of the drawings for easing the tight fitting of the can down through the ring. However, the preset down bending of the ring portions 37 has the opposite affect when attempting to pull the can out of the ring and therefore provides a very tight grip on the can. In fact, the tightness of this grip is such that there is essentially no movement of the lower end of the can which might otherwise result in its coming into contact with the gel filled walls of the insert.

FIG. 8 shows another feature of the ring where it will be clearly seen that the gripper portions 37 are of decreasing material thickness from reinforcing rib 41 inwardly to their free inner ends. Again, this feature enables a slight downward bending of the inner end of the gripper portions for easing the can fitting through the ring with increased outward resistance to bending of the gripper portions which are further strengthened against bending at the reinforcing rib 41. This feature provides a centering of the can by the ring in the insert with the ring being resistant to collapsing which might otherwise allow the can to shift into contact with the gel packed wall of the insert.

As will be clearly apparent from FIG. 5, although gripper portions 37 do resist downward bending, they will, if pushed sufficiently hard, bend downwardly to a point overlapping the interior wall of the gel insert. Therefore, in both a relaxed as well as a fully down bent position, gripper portions 37 define the minimum interior diameter of the entire cup once again preventing can or container contact with the insert sidewalls.

The description immediately above relates primarily to a cooler cup however, It is to be appreciated that the term "heat treatment cup" and "temperature conditionable" includes heating as well as cooling of the cup and the present invention is also applicable to heating as well as cooling of a beverage container. Furthermore, it is to be noted in both cases that the cup not only has insulating properties but, in addition, has the capacity to either lower or raise the temperature of a container fitted therein.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A hand held heat treatment receptacle for a beverage container, said receptacle comprising an outer insulating cover and a temperature conditionable insert fitted within said insulating cover, said insert comprising a pair of cup like members telescopically fitted with one another with engaging upper and lower wall regions with a hollowed sidewall therebetween which is substantially filled with a temperature conditionable fluid trapped in said hollowed sidewall between said engaging upper and lower wall regions, said receptacle having an upwardly opening mouth of lesser inside diameter than that of said insert for gripping on said container and preventing container contact with said sidewall of said insert.

2. A hand held receptacle as claimed in claim 1, wherein said engaging upper wall regions on said cup like members comprise lip portions extending outwardly directly over said insulating cover.

3. A hand held receptacle as claimed in claim 2, including a top elastic ring fitted over both said lip portions and said outer insulating cover for securing said insert and cover as an assembled unit.

4. A hand held receptacle as claimed in claim 3, wherein said ring includes an outer downwardly extending undercut flange portion for snapping over said lip portions on said cup like members and engaging said insulating cover.

5. A hand held receptacle as claimed in claim 4, wherein said insulating cover comprises a hollow open-ended sleeve, and wherein said insert provides support for engagement of said lip portions with said cover for the beverage container fitted in said receptacle.

6. A hand held receptacle as claimed in claim 3, wherein said ring includes an inwardly projecting skirt portion defining the mouth of lesser inside diameter than that of said insert.

7. A cup within a cup refrigerant insert for use in a beverage container cooler cup, said insert comprising inner and outer telescopically fitted outwardly flanged cups, said inner cup being of lesser diameter than said outer cup to define a hollow sidewall containing a freezable gel, said gel being trapped in said sidewall by a liquid tight seal between the outward flanges on said cups.

8. An insert as claimed in claim 7, including centering fins between said cups.

9. An insert as claimed in claim 8, wherein said fins are provided extending inwardly at the base of said outer cup for agitating the freezable gel during assembly of said insert.

10. An insert as claimed in claim 7, including a double sonic weld between the flanges of said cups.

11. A receptacle as claimed in claim 6, wherein said ring thickens outwardly for increased resistance to bending from said mouth.

* * * * *